US006792846B2

(12) United States Patent
Barrett

(10) Patent No.: US 6,792,846 B2
(45) Date of Patent: Sep. 21, 2004

(54) GAS DELIVERY SYSTEM

(75) Inventor: John F. Barrett, Sarasota, FL (US)

(73) Assignee: Universal Oxygen, Inc., Largo, FL (US)

( * ) Notice: Subject to any disclaimer, the term of this patent is extended or adjusted under 35 U.S.C. 154(b) by 280 days.

(21) Appl. No.: 09/963,915

(22) Filed: Sep. 26, 2001

(65) Prior Publication Data

US 2002/0040715 A1 Apr. 11, 2002

Related U.S. Application Data

(60) Provisional application No. 60/235,429, filed on Sep. 26, 2000.

(51) Int. Cl.[7] ..... F01B 11/02
(52) U.S. Cl. ..... 92/169.1; 417/273
(58) Field of Search ..... 92/169.1, 170.1, 92/248, 171.1; 417/273, 521, 571

(56) References Cited

U.S. PATENT DOCUMENTS

| | | | | | |
|---|---|---|---|---|---|
| 3,922,149 | A | | 11/1975 | Ruder et al. | 55/21 |
| 4,065,272 | A | | 12/1977 | Armond | 55/25 |
| 4,222,750 | A | | 9/1980 | Gauthier et al. | 55/58 |
| 4,331,455 | A | | 5/1982 | Sato | 55/21 |
| 4,539,818 | A | * | 9/1985 | Holland | 60/520 |
| 4,552,571 | A | | 11/1985 | Dechene | 55/21 |
| 4,673,415 | A | | 6/1987 | Stanford | 55/21 |
| 4,756,723 | A | | 7/1988 | Sircar | 55/25 |
| 4,798,493 | A | * | 1/1989 | Oda et al. | 417/407 |
| 4,822,384 | A | | 4/1989 | Kato et al. | 55/158 |
| 4,864,987 | A | * | 9/1989 | Kawamura | 123/193.4 |
| 4,869,733 | A | | 9/1989 | Stanford | 55/21 |
| 4,960,119 | A | | 10/1990 | Hamlin | 128/204.18 |
| 5,071,453 | A | | 12/1991 | Hradek et al. | 55/21 |
| 5,186,137 | A | * | 2/1993 | Salzmann | 123/192.2 |
| 5,199,423 | A | | 4/1993 | Harral et al. | 128/202.26 |
| 5,252,039 | A | * | 10/1993 | Mangyo et al. | 417/368 |
| 5,809,999 | A | | 9/1998 | Lang | 128/200.24 |
| 5,858,062 | A | | 1/1999 | McCulloh et al. | 95/8 |

FOREIGN PATENT DOCUMENTS

| | | | | |
|---|---|---|---|---|
| DE | 3437999 A1 | * | 4/1986 | F16J/10/04 |
| JP | 57079277 A | * | 5/1982 | F04B/39/12 |

OTHER PUBLICATIONS

Abstract, Japanese Patent No. JP359160515A published Sep. 11, 1984.
Abstract, Japanese Patent No. JP408294613A published Nov. 12, 1996.
Printout from www.rixindustries.com website entitled "Bottle Filling Oxygen Compressors", pp. 1–5.
Printout from www.rixindustries.com website entitled "Model 2V3B", 1 page.

* cited by examiner

*Primary Examiner*—Edward K. Look
*Assistant Examiner*—Igor Kershteyn
(74) *Attorney, Agent, or Firm*—Gifford, Krass, Groh, Sprinkle, Anderson & Citkowski, P.C.

(57) ABSTRACT

A submersible gas compressor is described which has a ceramic high pressure piston in contact with a ceramic sleeve, a drive piston mounted to the ceramic high pressure piston and a crank in mechanical connection with the drive piston. The submersible gas compressor can be used as a second stage compressor in a gas delivery system that includes a first stage low pressure compressor, an absorption bed containing molecular sieve material, a second stage compressor to pressurize a gas stream to a pressure between 5000 and 10,000 psig, a cascade system for storing the pressurized gas stream between 3500 and 5000 psig, a control system, and an outlet for delivering the pressurized gas stream.

13 Claims, 3 Drawing Sheets

GAS DELIVERY SYSTEM

RELATED APPLICATIONS

This application claims the priority of U.S. Provisional Application No. 60/235,429 filed Sep. 26, 2000, and is hereby incorporated by reference.

FIELD OF THE INVENTION

The present invention relates to a system for separating an atmospheric gas, purifying, compressing and storing the gas for subsequent delivery and, more particularly, to a system for compressing and storing gas at pressures of up to 5,000 psig.

BACKGROUND OF THE INVENTION

The benefits of oxygen in sustaining life beyond the obvious have been known for many years. In recent years, more and more uses of purified oxygen and oxygen enriched atmospheres has been discovered. Oxygen usage in the treatment of respiratory distress from emphysema and other pulmonary disorders has been available for many years. However, treatment of Caisson's disease with enriched atmospheres in hyperbaric chambers has led to the discovery of enriched atmosphere wound treatment at elevated pressures. Day after day, the benefits of oxygen have been discovered from medical applications to aquaculture, disinfecting, cleaning and sanitizing and nutrition. Purified oxygen has been available from large suppliers who have placed large manufacturing facilities throughout the country and world in order to deliver special gases including oxygen. These facilities have barely addressed a portion of the global demand for oxygen. Areas where the infrastructure is challenged must do without the benefits of oxygen or pay a high price to obtain the needed gas.

A system that can remove the oxygen from the air, purify it, safely compress it to a level in which it can be stored either in a cascade system for distribution within a medical facility or into portable containers for transportation is needed. This system should also have the capability to continuously monitor the gas and the concentration it will be blending the gas with other gases. Today, the compression of oxygen has been limited to extremely expensive high volume systems used by the cryogenic companies or to small air cooled compressors. The latter with extreme danger due to materials compatibility and heat generated. These smaller systems also are only capable of compressing to less than 2,700 pounds per square inch due to these situations.

Oxygen generation has been available for many years. However, the ability to economically compress the gas to a level to store it for later use has not been available. Once the gas reaches a certain pressure, the gas becomes unstable due to the temperature developed reaching those pressures. The natural gas laws state that the temperature will rise as work is put into the compression of the gas. This added temperature comes from the excitation of molecules from the added work, from the friction of the mechanical process and the friction of the gas passing through an orifice. This temperature will build until the system reaches equilibrium through heat dissipation or the gas will super heat. The faster the heat is removed, the more efficient and safer the system will be. Current compression systems remove the heat using convection. That is heat removal using forced air.

Thus, there exists a need for a system that efficiently compresses and stores gas at a pressure higher than the conventional transport bottle pressure of about 3,000 psig and is able to deliver low pressure inlet gas, low pressure purified gas, high pressure purified gas, high pressure inlet gas or mixtures thereof through blending.

SUMMARY OF THE INVENTION

A submersible gas compressor is provided having a ceramic high pressure piston in contact with a ceramic sleeve, a drive piston mounted to the ceramic high pressure piston and a crank in mechanical connection with the drive piston.

A gas delivery system is provided including a first stage low pressure compressor to pressurize an inlet gas, an absorption bed containing molecular sieve material connected to the first stage compressor so that compressed inlet gas comes in contact with the absorbent bed material and is enriched in at least one component present in the inlet gas yielding an exit gas, a second stage compressor immersed in a liquid heat transfer fluid, the second compressor compressing the exit gas to a pressurized gas stream having a pressure between 5000 and 10,000 psig, a cascade system for storing the pressurized gas stream between 3500 and 5000 psig, a control system in control of at least one of the first compressor, the absorbent bed, the second compressor and the cascade system, and an outlet for delivering the pressurized gas stream.

DETAILED DESCRIPTION OF THE PREFERRED EMBODIMENTS

The present invention is detailed with respect to a gas delivery system for separating, purifying, compressing and storing the atmospheric gas oxygen. It is appreciated that other inlet atmospheric gases are readily separated, purified, compressed and stored according to the present invention as well. Further, gas feed stocks other than atmospheric air are readily delivered according to the present invention. While the following description specifically pertains to oxygen, it is appreciated that the present invention is also operative with other gases illustratively including nitrogen, argon, helium, carbon dioxide, carbon monoxide, hydrogen, acetylene and other gaseous mixtures.

Figure 2:
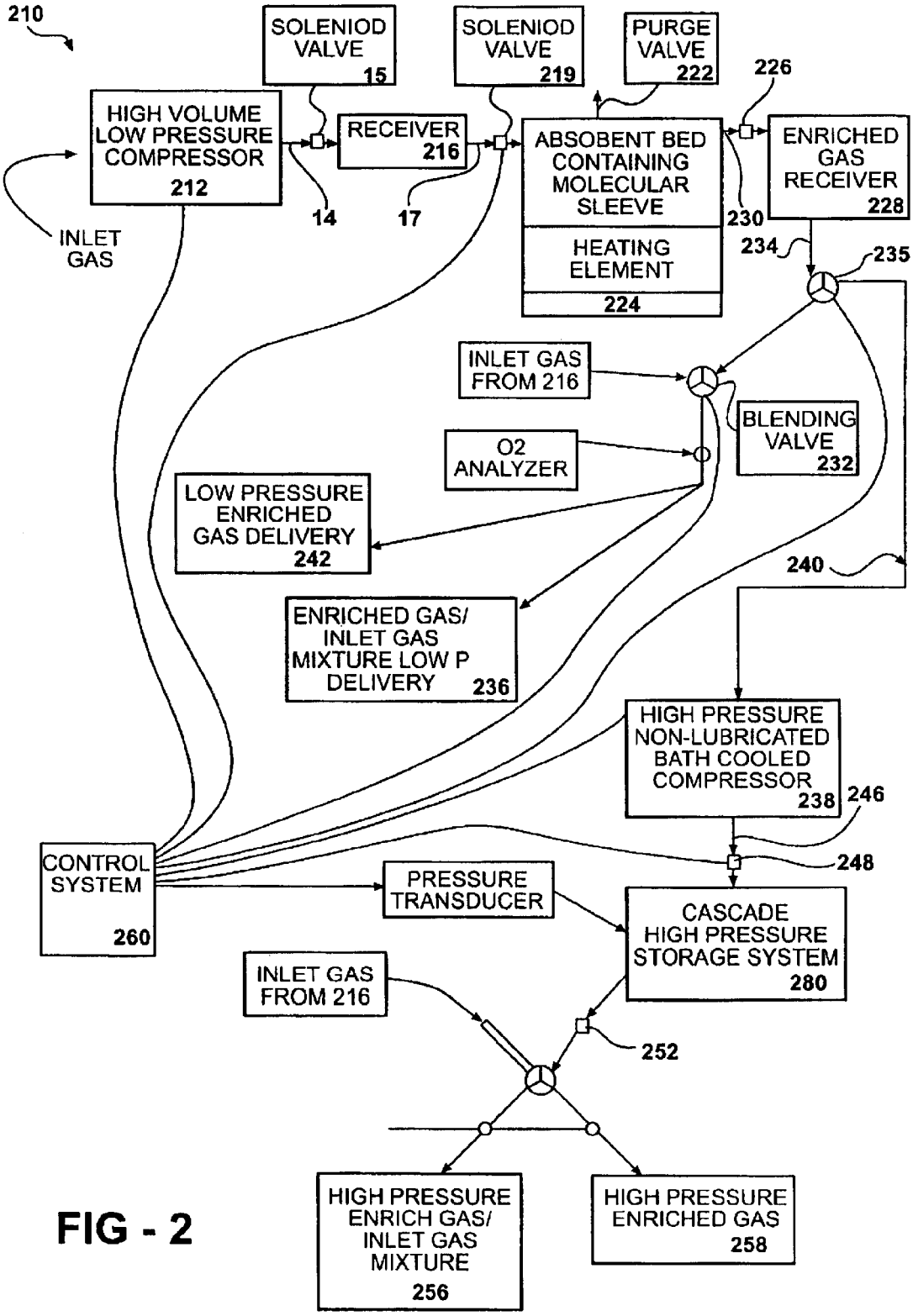
FIG. 2 is a block diagram schematic showing a delivery system according to the present invention.

A delivery system according to the present invention is shown generally at 210 in FIG. 2. Inlet gas air is input into a high volume, low pressure compressor 212 having an output pressure of from about 100 to 500 psig. The air compressor 212 feeds pressurized air through a conduit 214 through a solenoid valve 215 to receiver 216 for storage at from about 20 to 100 psig. The receiver 216 is in fluid communication with an absorption bed 218 by way of a conduit 217 and a valve 219. A molecular sieve 220 or similar substance is incorporated within the bed 218 and is selected for the ability of absorbing feedstock gases in the supplied inlet gas stream without chemical reaction such that the desired enrichment gas has a preferentially low absorption. In the case of oxygen selection, suitable molecular sieve materials illustratively include pelletized zeolite type 5A as well as other molecularly selective media. The absorption bed 218 is included within a pressure suitable container typically manufactured from steel. Gas exiting the absorption bed 218 typically is about 93% oxygen and 7% noble gases including argon and helium based upon an ambient atmosphere feed gas. The absorption bed 218 is provided with a purge valve 222 and a heating element 224. The purge valve 222 and heating element 224 being utilized to regenerate the molecular sieve 220 after prolonged usage. A solenoid valve 226 meters oxygen enriched gas into a low pressure oxygen storage receiver 228 by way of a conduit 230. It is appreciated that an optional second absorption bed (not shown) is piped in series with the absorption bed 218 to provide a further oxygen enriched gas stream to the low pressure oxygen storage receiver 228. Through the use of multiple absorption beds, oxygen concentrations exceeding 99 total molar percent are readily attained. A blending valve 232 is connected by way of conduit 234 and valve 235 to the low pressure oxygen storage receiver 228. The blending valve 232 also intakes ambient air inlet gas or gas stored within receiver 216 to provide oxygen enriched breathing air 236 as an output product as required. The oxygen enriched gas stored within low pressure oxygen storage receiver 228 is typically stored at a pressure between 45 and 55 psig. The gas within receiver 228 not blended with air and outputted as enriched breathing air 234 is shunted to a high pressure stage compressor 238 by way of conduit 240. The high pressure compressor 238 is detailed with greater specificity in FIG. 3 and is characterized as having a composite material construction that is bath cooled and operates independent of liquid lubricants. The high pressure compressor 238 operates below 130° F. and is capable of compression to 4,500 to about 10,000 psig. The output from the compressor 238 is metered through a conduit 246 by a solenoid valve 248 into a cascade system 250 for high pressure, high volume storage of gas. Storage 250 being at pressures less than the pressures outputted by high pressure compressor 238. Thus, for example, compressor 238 operating at 10,000 psig output is stored at approximately 5,000 psig. The high pressure oxygen enriched gas within storage 250 is delivered through a blending valve 252 by way of conduit 254. Blending valve 252 also intakes ambient atmosphere or gas from receiver 216 to selectively deliver high pressure oxygen enriched air or when no air is input, high pressure oxygen 258 is delivered. The high pressure compressor stage 238 according to the present invention provides improvements over conventional high pressure compressors in operating at a lower number of revolutions per minute (rpm) with fewer stages to yield comparable volumes and pressures as compared to conventional high pressure compressors. As a result of the lower rpm generated by a high pressure compressor according to the present invention, noise levels of less than 70 decibels are noted for a compressor capable of delivering 10,000 psig as compared to a conventional compressor of the same output which typically operates in excess of 120 decibels. The reduced size, complexity, and operating noise of the present invention makes on site delivery of variable pressure and enriched gas products available on site in facilities such as hospitals, factories, waste treatment plants and the like. A control system 260 continuously operates and monitors the process of the instant invention. The control system 260 receives input from oxygen concentration sensors and pressure monitors throughout the system 210 and operates the valves, regulates compressor speeds and the like.

The present invention is a self-contained oxygen generation, compression and storage system. The system upon attachment to electrical power begins storing oxygen. The system is intended to free facilities from the delivery of oxygen and the reliance on suppliers and produce oxygen at a lower cost.

Once attached to electrical power, the computer control system 260 energizes and allows a user to determine the product and concentration required. Once the user initiates the process, the system begins by compressing air, filtering the air and storing the air in the receiver 15 to 125 psig. The absorption bed 218 requires a large volume of pressurized air to supply the molecular sieves 220. Since air is approximately 20% by volume oxygen, the sieves 220 discard nearly 80% of their supply as unusable. As the gas flow exits the absorption bed 218, the output is 93% pure oxygen with the trace noble gases remaining. This gas flow exits at a pressure of approximately 40–50 psig. The gas is stored in the receiver 228 at that pressure. From the receiver 228, the gas is sent to a high-pressure compressor 238.

Divers and fire fighters typically use this blend in portable breathing devices. The nitrox blending is close loop computer controlled and monitored with analyzers 262 to continuously audit the mix purity.

Figure 3:
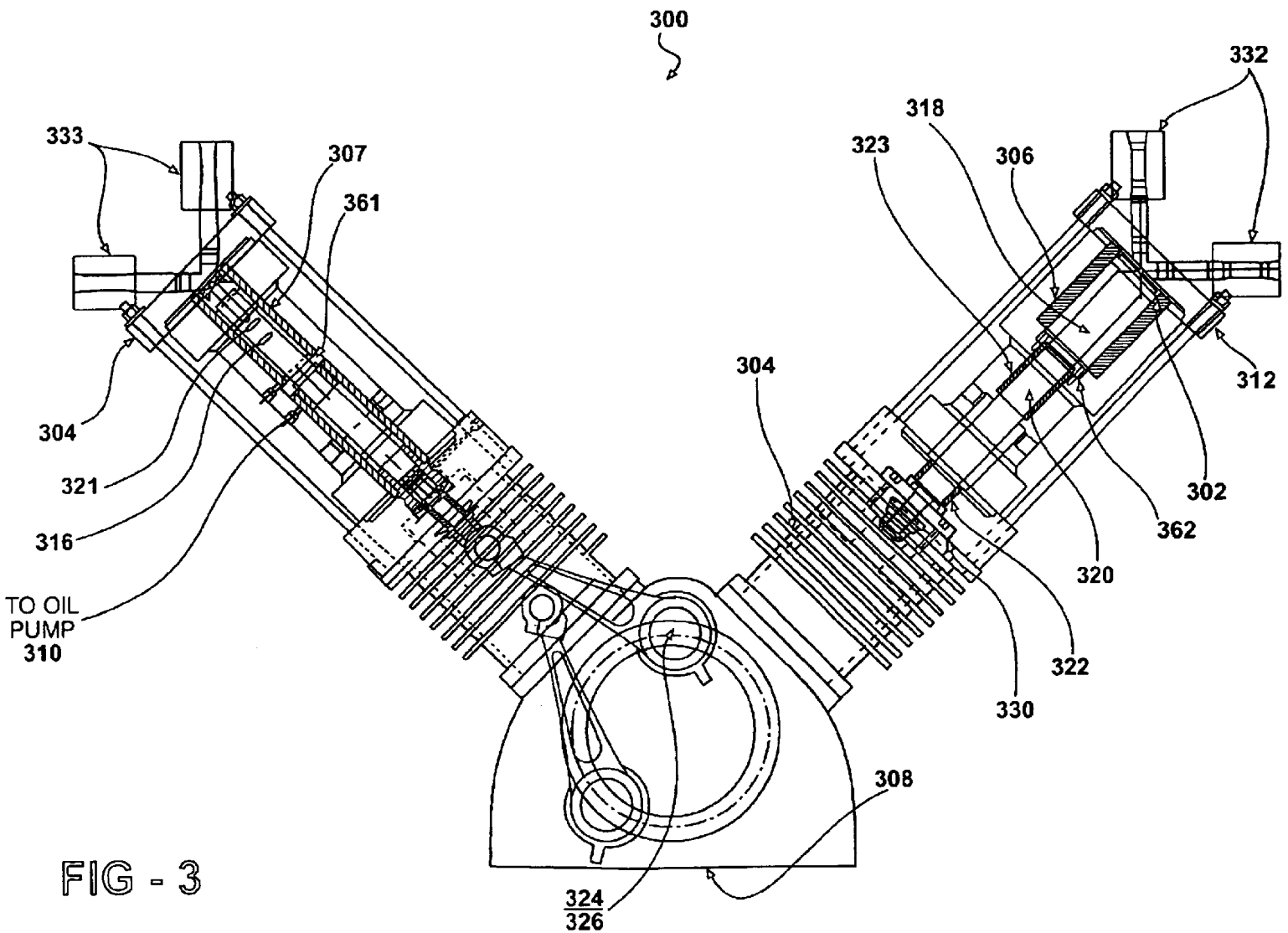
FIG. 3 is a partial cutaway side view of a compressor according to the present invention.

A high pressure compressor according to the present invention 300 is shown in FIG. 3. A high pressure piston 318 rides on a piggyback drive piston 304. To assure long life of the compressor 300, a piston shaft 306 320 is run through at least two liner bushings 322 and 323 equipped with oil grooves ported specifically for the return of oil to a crankcase 308. The liners 322 and 323 are fed oil through a high pressure gear pump 310 having an oil filter generating oil pressures in excess of 300 psig. Compressor heads 312 and 314 include check valve cartridges 332 and 333, respectively. The check valve cartridges according to the present invention facilitate cleaning to a high period of gas delivery as well as field repair and maintenance. Copolymer wipers 361 and 362 are provided to create a barrier preventing oil and contaminants from entering the compression chambers 316 and 318, respectively. The copolymer wipers 361 and 362 are formed from a variety of polymeric materials illustratively including glass filled Teflon with stainless backup rings. The compression chambers 316 and 318 are defined by composite material cylinder sleeves 306 and 307. Preferably, piston components contacting the cylinder sleeves are formed of the same composite material. The composite material is selected to demonstrate high temperature stability, durability, chemical resistance and the ability to operate absent a liquid lubricant. Composite materials suitable for cylinder sleeve and piston manufacture illustratively include complementary grades of alumina oxide. Preferably, a cylinder sleeve and piston are machined in a matching set in order to obtain precision fits and seal.

The high pressure compressor design according to the present invention is designed for submersible mounting within a coolant tank (not shown) wherein the compressor drive remains outside of the tank. The tank has interfacial seals which keep water within the tank and allow the water to circulate freely around the compressor 300 in order to keep the compressor block 220 cool in addition to the heat exchanger 322.

A compliant coupling 330 mounts between the drive piston 304 and the high pressure piston 302. The compliant coupling 330 allows the drive piston 304 to move while the pressure piston 318 is securely and accurately guided within the cylinder sleeve 306. Compliant coupling 330 serves to reduce wear between the piston 318 and the cylinder sleeve 306. The crank 324 has a double hung shaft 326 obviating a cantilever action on the crank 324 during compression cycles. The compressor 300 according to the present invention preferably operates at a speed of between about 600 and 800 rpms. More preferably, the compressor 300 operates at about 600 rpms, which is approximately one-third the speed of conventional compressors.

This along with about eighty feet of high-pressure heat exchanger tubing keeps the oxygen at a safe temperature during the compression. In the rare event of a flammable gas leak from the present invention, the possibility of flash will be minimized due to the submerged design. During this process, the gas will pass through and be sampled by a set of analyzers that will be monitoring the concentration of oxygen, presence of carbon monoxide, water vapor and carbon dioxide. The computer control system 360 also reports through an operator touch screen interface (not shown) the results while storing the data. A modem system is optionally incorporated into the system to allow periodic off site monitoring of the system and the process from the manufacturer.

The output of the compressor will be directed to a bank of cascade high-pressure storage tanks. The tanks will supply the users with the necessary volume. In most cases, the remote locations requiring oxygen can now have what they need when they need it. This will come at a fraction of the cost of delivery.

EXAMPLE

Figure 1:
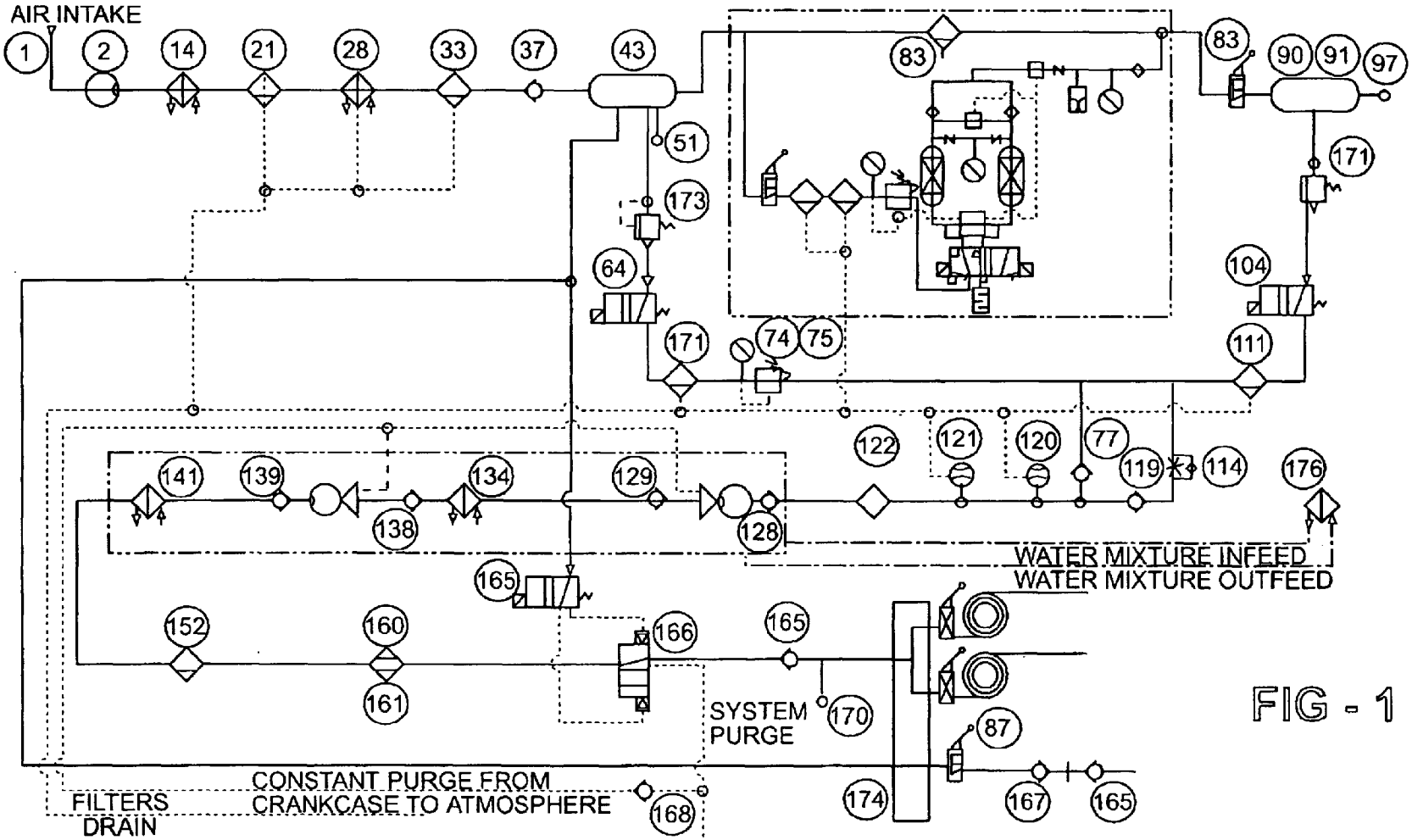
FIG. 1 is a schematic showing an example of a delivery system according to the present invention.

A schematic of an embodiment according to the present invention is shown at FIG. 1. FIG. 1 index numbers correspond to the following components:

An air intake filter 1 such as that furnished General Air (Rotary Air), filters air that is then conducted to a low pressure compressor 2, such as #AM7.5HD-60/3 provided by General Air (Rotary Air). The low pressure compressor 2 produces relatively low pressure compressed air, in the range of 90 to 500 psig, that is subsequently directed to an aftercooler 14, such as that furnished by General Air (Rotary Air). The aftercooler is connected to a filter 21, such as HN2S-3PUA supplied by General Air (Parker), for removal of particulates. Following filtration air is directed to a dryer 28, such as DE102 from General Air (MTA) and a coalescing filter 33, such as HN2S-10CA before reaching a check valve 37, such as 00339 3003 from Parker, and then a receiver 43 such as a 30 gallon receiver, GB-30, supplied by General Air. The receiver 43 is in communication with a 0–200 transducer 51, for example that commercially available from Instrument Specialties as #LMV-200. The receiver 43 has connections to several air pathways. In a first alternative route, the air can be directed to a branched path wherein a first branch leads to a three-way solenoid valve 165, such as that available commercially from Silliman (TPC) as DX2-FG-S1SSUA03, followed by a high pressure air pilot purge valve 166 such as that available from Autoclave as SW6075-OM. The purge valve opens to a system purge and check valve 168 and, alternatively, to a check valve 171. Connected to the check valve 171 is an air pathway, with a connection to a 0-5000 PSI transducer, such as that from Instrument Specialties #LMV-5000. The air pathway is connected to a distribution manifold 174 which may be from Dynax, Inc., #316 stainless steel for example. The second branch of the branched path is connected to a locking ball valve 87 and to relief valves 167 and 169.

A second alternative route for air leaving the receiver 43 is via a 3-way solenoid valve 64. The solenoid valve is connected to a coalescing filter 71, such as model #HN2S-6A available from General Air (Parker) which is connected to a pressure regulator with a gauge 74, such as #1274G-3AT-RSG obtainable from Norgren. The pressure regulator is in communication with a check valve 77, which may be #00339 3002 sold by Parker. Connected to the check valve 77, is an oxygen analyzer, 120, which is connected to a carbon monoxide sensor 121, which is in turn connected to a relative humidity sensor 122. The analyzer, CO sensor and the humidity sensor used may be of the types available from Instrument Specialties as #XM02-2L-11(XCAL-41), #A-TOX-11-BM-MO-10-000-0 and #CMS-1-1-1, respectively. The humidity sensor, 122, is connected to a check valve low pressure head inlet, 128, and the check valve, 128, is in communication with a check valve low pressure head output, 129, both check valves 128 and 129 are such as are available from Rego as #CG375B. Check valve 129 is connected to an innercooler 134 coil #1 and #2 such as available from Dynax, Inc. The innercooler 134 is connected to a check valve high pressure head inlet, 138, and the check valve, 138, is in communication with a check valve high pressure head output, 139, both check valves 138 and 139 are such as are available from Rego as #CG375SS. Check valve 139 is connected to an aftercooler 141 coil #1 and #2 such as available from Dynax, Inc. Connected to the aftercooler 141 is a filter separator 152, such as #4516N TF-B3 CL from Norman Filters. The filter separator 152 is connected to a filter housing 160 and a filter cartridge 161, #s PU-530003-AF and X53249 respectively, available from Lorence Factor. The filter housing 160 and filter cartridge 161 are connected to the high pressure air pilot purge valve 166 and downstream components as described above.

A third alternative route for directing air from the receiver 43 is a branched route in which the first branch leads to an oxygen generator 83, the oxygen generator in turn is connected to a locking ball valve 87. The second branch of the third route leads to selective absorption bed materials, and then to the locking ball valve 87. The valve 87 is in communication with a receiver 90, such as the 30 gallon receiver GB-30 from General Air. The receiver 90 is connected to a 0-200 PSI transducer 97 such as LMV-200 from Instrument Specialties. The receiver 90 is connected to a check valve 171, such as CG375SS available from Rego. The check valve 171 connects to a 3-way solenoid valve 104 which connects to a coalescing filter 111. The coalescing filter 111 is in communication with a blending system 114, such as is available from Instrument Specialties as TDFXPD6000-405. The blending system 114 is connected to a check valve 119 which is in turn connected to check valve 77 and oxygen analyzer 120. A water chiller 176, such as RV01A1N, 140 PSI, from General Air (TPA) is provided to cool high pressure compressor system components shown generally in the box outlined in FIG. 1 which contains elements 128, 129, 134, 138, 139 and 141.

The present invention has been described with reference to preferred embodiments. It is appreciated that there will be modifications to the present invention that fail to depart from the spirit thereof as detailed herein. Such modifications are intended to fall within the scope of the appended claims.

What is claimed is:

1. A submersible gas compressor comprising:

a ceramic high pressure piston in contact with a ceramic sleeve operating independent of a lubricating liquid;

a drive piston mounted to said ceramic high pressure piston such that movement of said drive piston simultaneously moves said ceramic high pressure piston; and a crank in mechanical connection with said drive piston.

2. The compressor of claim 1 further comprising a surrounding thermal immersion tank comprising a liquid heat transfer fluid.

3. The compressor of claim 1 further comprising a compliant coupling between said ceramic high pressure piston and said drive piston.

4. The compressor of claim 1 wherein said crank has a double hung shaft operating independent of cantilever motion.

5. The compressor of claim 1 wherein the movement of said drive piston cycles between 600 and 800 cycles per minute.

6. A submersible gas compressor comprising:

a ceramic high pressure piston in contact with a ceramic sleeve operating independent of a lubricating liquid;

a drive piston mounted to said ceramic high pressure piston such that movement of said drive piston simultaneously moves said ceramic high pressure piston;

a crank in mechanical connection with said drive piston; and a surrounding thermal immersion tank comprising a liquid heat transfer fluid, wherein the liquid heat transfer fluid is an aqueous solution.

7. The compressor of claim 6 further comprising a compliant coupling between said ceramic high pressure piston and said drive piston.

8. The compressor of claim 6 wherein said crank has a double hung shaft operating independent of cantilever motion.

9. The compressor of claim 6 wherein said ceramic high pressure piston contacts said ceramic sleeve independent of a lubricating liquid.

10. The compressor of claim 6 wherein the reciprocating movement of said drive piston cycles between 600 and 800 cycles per minute.

11. A submersible gas compressor comprising:

a ceramic high pressure piston in contact with a ceramic sleeve wherein the compressor operates continuously at less than 130° F.;

a drive piston mounted to said ceramic high pressure piston such that movement of said drive piston simultaneously moves said ceramic high pressure piston; and a crank in mechanical connection with said drive piston.

12. A submersible gas compressor comprising:

a ceramic high pressure piston in contact with a ceramic sleeve operating independent of a lubricating liquid;

a drive piston mounted to said ceramic high pressure piston such that movement of said drive piston simultaneously moves said ceramic high pressure piston;

a crank in mechanical connection with said drive piston; and a surrounding thermal immersion tank comprising a liquid heat transfer fluid, wherein the compressor operates continuously at less than 130° F.

13. A submersible gas compressor comprising:

a ceramic high pressure piston in contact with a ceramic sleeve;

a drive piston mounted to said ceramic high pressure piston such that movement of said drive piston simultaneously moves said ceramic high pressure piston;

a crank in mechanical connection with said drive piston; and a thermal immersion tank comprising a liquid heat transfer fluid.

* * * * *